US010677246B2

(12) United States Patent
Nemit, Jr.

(10) Patent No.: US 10,677,246 B2
(45) Date of Patent: Jun. 9, 2020

(54) VARIABLE VOLUME RATIO COMPRESSOR

(71) Applicant: Johnson Controls Technology Company, Milwaukee, WI (US)

(72) Inventor: Paul Nemit, Jr., Greencastle, PA (US)

(73) Assignee: Johnson Controls Technology Company, Auburn Hills, MI (US)

( * ) Notice: Subject to any disclaimer, the term of this patent is extended or adjusted under 35 U.S.C. 154(b) by 306 days.

(21) Appl. No.: 15/649,556

(22) Filed: Jul. 13, 2017

(65) Prior Publication Data

US 2018/0017060 A1 Jan. 18, 2018

Related U.S. Application Data

(60) Provisional application No. 62/363,543, filed on Jul. 18, 2016.

(51) Int. Cl.

| | |
|---|---|
| ***F04C 18/16*** | (2006.01) |
| ***F04C 28/26*** | (2006.01) |
| ***F04C 28/14*** | (2006.01) |

(52) U.S. Cl.

CPC ..... *F04C 18/16* (2013.01); *F04C 28/26* (2013.01); *F04C 28/14* (2013.01)

(58) Field of Classification Search

CPC ..... F04C 18/16; F04C 28/26

See application file for complete search history.

(56) References Cited

U.S. PATENT DOCUMENTS

| | | | | |
|---|---|---|---|---|
| 4,234,296 | A * | 11/1980 | Matsubara | F04C 28/125 418/159 |
| 5,051,077 | A * | 9/1991 | Yanagisawa | F04C 18/16 418/197 |
| 6,530,753 | B2 * | 3/2003 | Aramaki | F04C 18/16 417/310 |
| 8,221,104 | B2 * | 7/2012 | Wilson | F04C 18/16 417/310 |
| 2007/0092393 | A1 * | 4/2007 | Egan | F04C 18/16 418/201.1 |

(Continued)

FOREIGN PATENT DOCUMENTS

| | | |
|---|---|---|
| CN | 102165197 A | 8/2011 |
| CN | 102414448 A | 4/2012 |
| CN | 102477980 A | 5/2012 |

(Continued)

OTHER PUBLICATIONS

PCT International Search Report & Written Opinion for Application No. PCT/US2017/042660 dated Sep. 25, 2017, 21 pgs.

*Primary Examiner* — Mary Davis
(74) *Attorney, Agent, or Firm* — Fletcher Yoder, P.C.

(57) ABSTRACT

A compressor and method for controlling the volume ratio of a compressor is provided. The compressor includes a an intake passage, a discharge passage and a compression mechanism, the compression mechanism being positioned to receive vapor from the intake passage and provide compressed vapor to the discharge passage. At least one opening is positioned in the compression mechanism to bypass a portion of the vapor in the compression mechanism to the discharge passage, the at least one opening being sized and positioned to automatically vary a volume ratio in the compressor in response to a varying pressure differential between the intake passage and the discharge passage.

20 Claims, 9 Drawing Sheets

(56) References Cited

U.S. PATENT DOCUMENTS

2011/0038747 A1* 2/2011 Shoulders ..... F04C 18/16
418/201.2

FOREIGN PATENT DOCUMENTS

| | | | |
|---|---|---|---|
| CN | 103857915 | A | 6/2014 |
| CN | 105579709 | A | 5/2016 |
| EP | 2343457 | A1 | 7/2011 |
| EP | 2458215 | A2 | 5/2012 |
| WO | 2010008457 | A2 | 1/2010 |
| WO | 2013146674 | A1 | 10/2013 |
| WO | 2015051019 | A1 | 4/2015 |
| WO | 2015094466 | A1 | 6/2015 |

* cited by examiner

VARIABLE VOLUME RATIO COMPRESSOR

CROSS-REFERENCE TO RELATED APPLICATIONS

This application is claims priority to and the benefit of U.S. Provisional Application Ser. No. 62/363,543, filed Jul. 18, 2016, entitled "VARIABLE VOLUME RATIO COMPRESSOR," which is herein incorporated by reference in its entirety for all purposes.

BACKGROUND

The present disclosure generally relates to positive-displacement compressors. More specifically, the present disclosure relates to controlling the volume ratio of a screw compressor.

In a rotary screw compressor, intake and compression can be accomplished by two tightly-meshing, rotating, helically lobed rotors that alternately draw gas into the threads and compress the gas to a higher pressure. The screw compressor is a positive displacement device with intake and compression cycles similar to a piston/reciprocating compressor. The rotors of the screw compressor can be housed within tightly fitting bores that have built-in geometric features that define the inlet and discharge volumes of the compressor to provide for a built-in volume ratio of the compressor. The volume ratio of the compressor should be matched to the corresponding pressure conditions of the system in which the compressor is incorporated, thereby avoiding over or under compression, and the resulting lost work. In a closed loop refrigeration or air conditioning system, the volume ratio of the system is established in the hot and cold side heat exchangers.

Fixed volume ratio compressors can be used to avoid the cost and complication of variable volume ratio machines. A screw compressor having fixed inlet and discharge openings built into the housings can be optimized for a specific set of suction and discharge conditions/pressures. However, the system in which the compressor is connected rarely operates at exactly the same conditions hour-to-hour, especially in an air conditioning application. Nighttime, daytime, and seasonal temperatures can affect the volume ratio of the system and the efficiency with which the compressor operates. In a system where the load varies, the amount of heat being rejected in the condenser fluctuates causing the high side pressure to rise or fall, resulting in a volume ratio for the compressor that deviates from the compressor's optimum volume ratio.

Volume ratio or volume index (Vi) is the ratio of volume inside the compressor when the suction opening closes to the volume inside the compressor just as the discharge opening opens. Screw compressors, scroll compressors, and similar machines can have a fixed volume ratio based on the geometry of the compressor.

To increase efficiency, the pressure inside the chamber of the compressor should be essentially equal to the pressure in the discharge line from the compressor. If the inside pressure exceeds the discharge pressure, there is overcompression of the gas, which creates a system loss. If the interior or inside pressure is too low, back flow occurs when the discharge opening opens, which creates other system losses.

For example, a vapor compression system such as a refrigeration system can include a compressor, condenser, expansion device, and evaporator. The efficiency of the compressor is related to the saturated conditions within the evaporator and the condenser. The pressure in the condenser and the evaporator can be used to establish the pressure ratio of the system external to the compressor. For example, the pressure ratio/compression ratio for a compressor can be established to be 4. The volume ratio or Vi is linked to the compression ratio by the relationship Vi raised to the power of 1/k; k being the ratio of specific heat of the gas or refrigerant being compressed. Using the previous relationship, the volume ratio to be built into the compressor geometry for the current example would be 3.23 for optimum performance at full load conditions. However, during a partial load, low ambient conditions, or at nighttime, the saturated condition of the condenser in the refrigeration system decreases, while the evaporator condition remains relatively constant. To maintain enhanced performance of the compressor at partial load or low ambient conditions, the Vi for the compressor should be lowered to 2.5.

Therefore, what is needed is a system to vary the volume ratio of the compressor without using costly and complicated valves.

SUMMARY

One embodiment of the present disclosure is directed to a compressor including an intake passage, a discharge passage and a compression mechanism, the compression mechanism being positioned to receive vapor from the intake passage and provide compressed vapor to the discharge passage. At least one opening is positioned in the compression mechanism to bypass a portion of the vapor in the compression mechanism to the discharge passage, the at least one opening being sized and positioned to automatically vary a volume ratio in the compressor in response to a varying pressure differential between the intake passage and the discharge passage.

Another embodiment of the present disclosure is directed to a method for controlling a volume ratio of a compressor, the method including providing a compression mechanism, the compression mechanism being positioned to receive vapor from an intake passage and provide compressed vapor to a discharge passage. The method further includes forming at least one opening positioned in the compression mechanism to bypass a portion of the vapor in the compression mechanism to the discharge passage, the at least one opening being sized and positioned to automatically vary a volume ratio in the compressor in response to a varying pressure differential between the intake passage and the discharge passage.

Embodiments of the present disclosure are directed toward improving an energy efficiency rating (EER) over a fixed volume ratio compressor due to enhanced partial load performance resulting from the use of a lower volume ratio.

Embodiments of the present disclosure are directed toward matching of the Vi of the compressor to the pressure conditions in the system to minimize the system losses.

Embodiments of the present disclosure are directed toward improving compressor efficiency at low condenser pressures and improving partial load efficiency by equalizing the exiting pressure of the compressor with the measured discharge pressure.

DETAILED DESCRIPTION OF THE EXEMPLARY EMBODIMENTS

Figure 1:
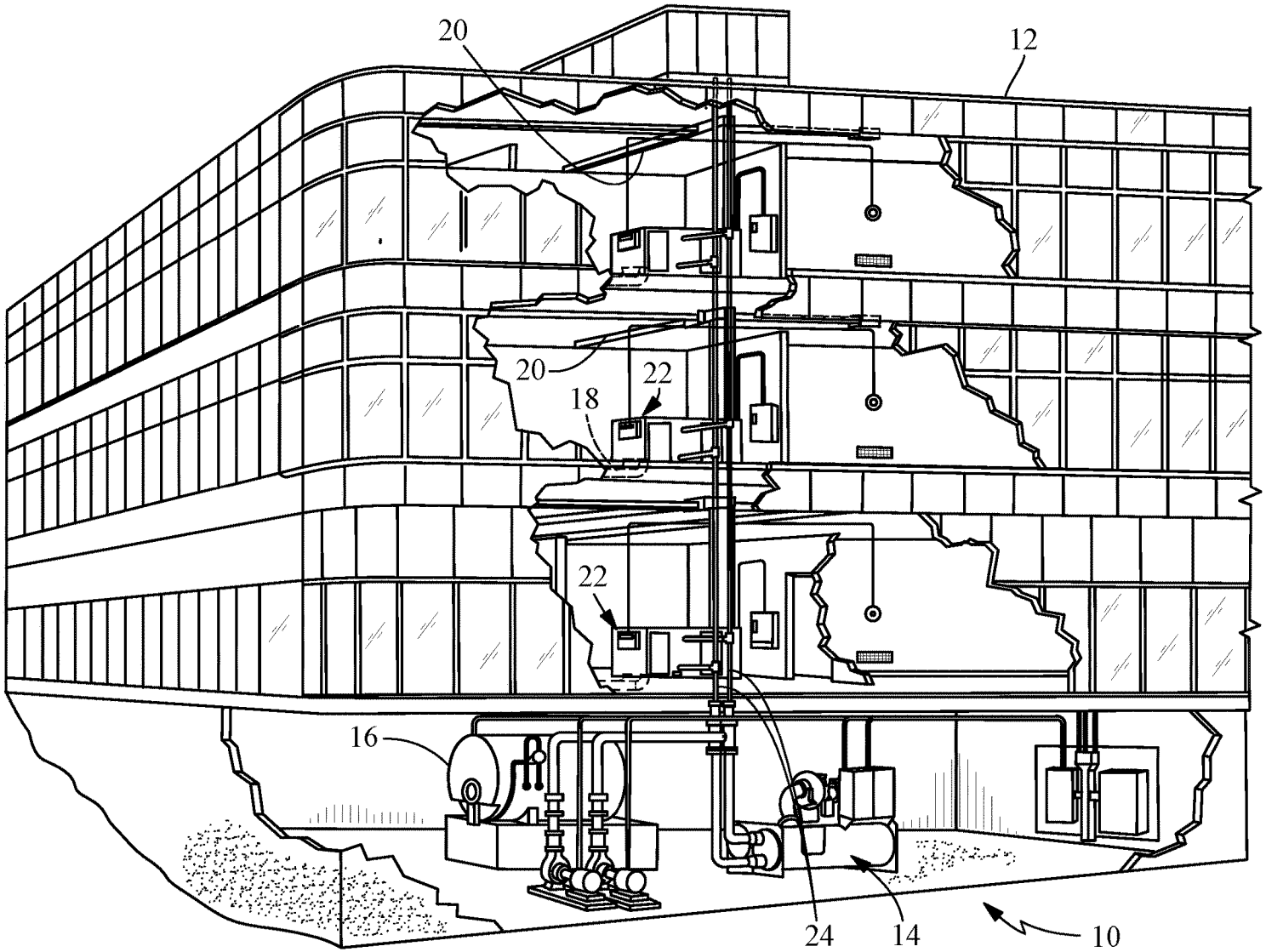
FIG. 1 shows an embodiment of a heating, ventilation and air conditioning system, in accordance with an aspect of the present disclosure.

FIG. 1 shows an environment of a heating, ventilation, and air conditioning (HVAC) system 10 in a building 12 for a typical commercial setting. The system 10 can include a vapor compression system 14 that supplies a chilled liquid which may be used to cool the building 12. The system 10 can include a boiler 16 to supply heated liquid that may be used to heat the building 12, and an air distribution system which circulates air through the building 12. The air distribution system can also include an air return duct 18, an air supply duct 20 and an air handler 22. The air handler 22 can include a heat exchanger that is connected to the boiler 16 and the vapor compression system 14 by conduits 24. The heat exchanger in the air handler 22 may receive either heated liquid from the boiler 16 or chilled liquid from the vapor compression system 14, depending on the mode of operation of the system 10. The system 10 is shown with a separate air handler on each floor of the building 12, but it should be appreciated that the components may be shared between or among floors.

Figure 2:
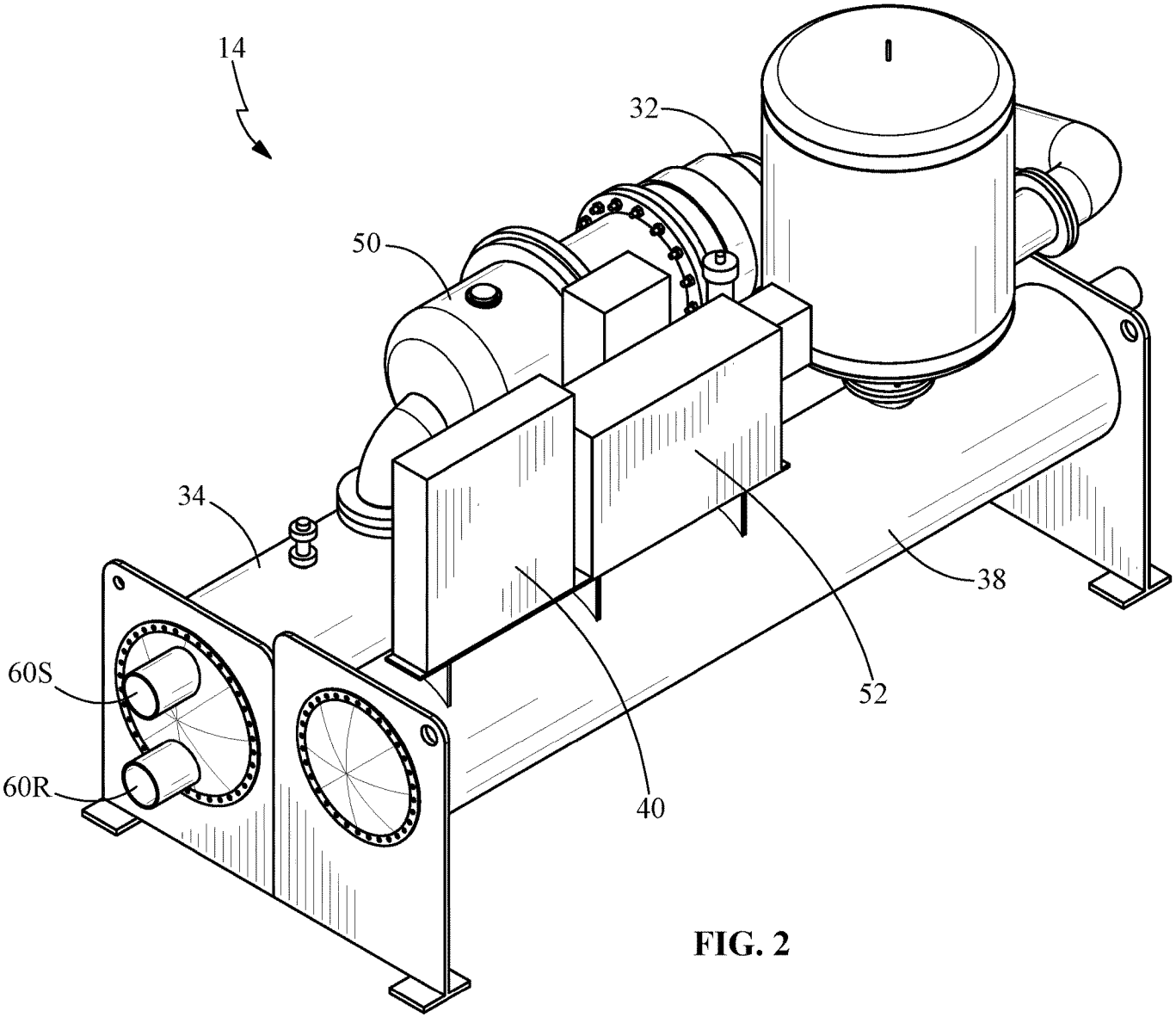
FIG. 2 shows an isometric view of an embodiment of a vapor compression system, in accordance with an aspect of the present disclosure.
Figure 3:
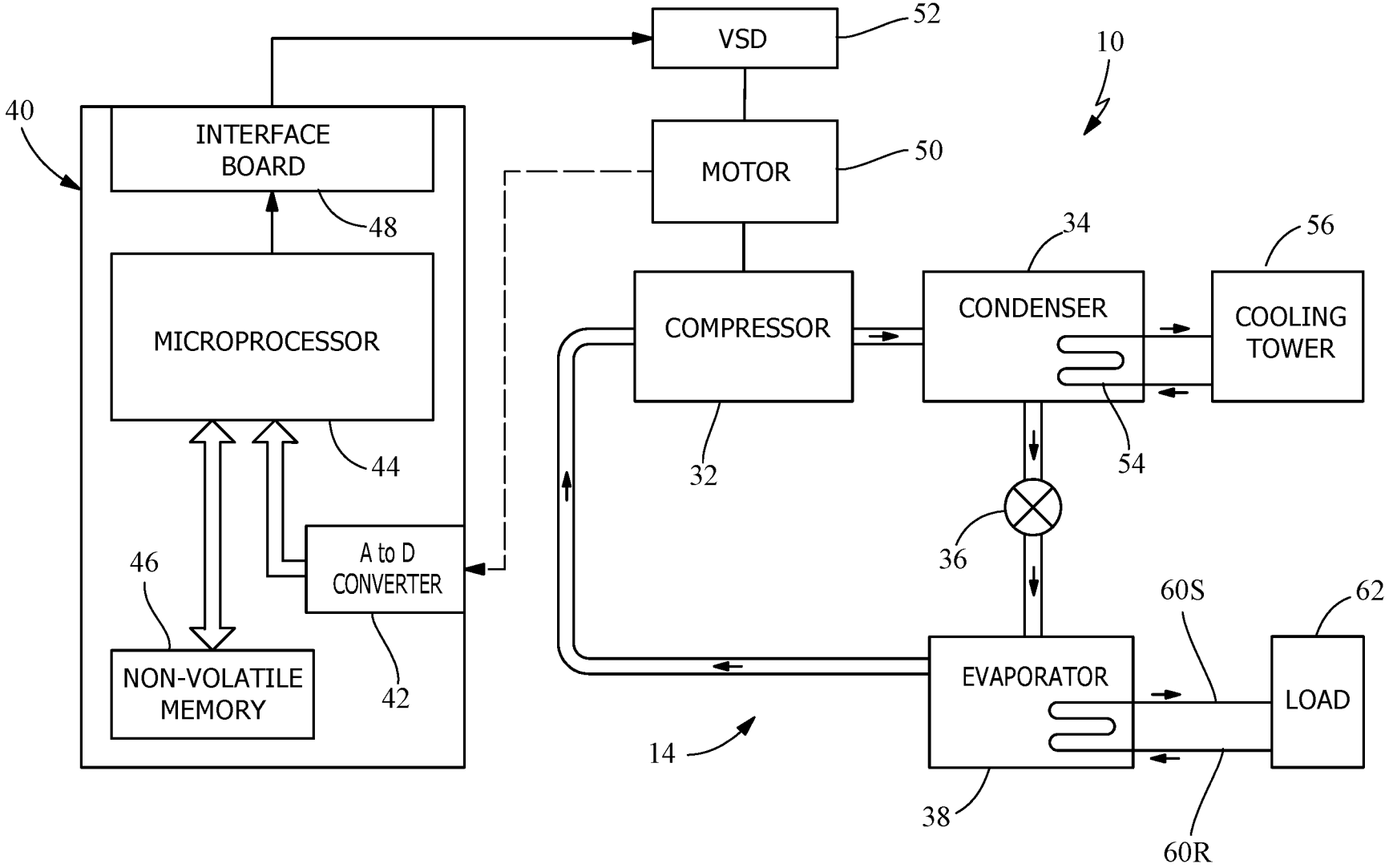
FIGS. 3 and 4 schematically show embodiments of a vapor compression system, in accordance with an aspect of the present disclosure.

FIGS. 2 and 3 show embodiments of the vapor compression system 14 that can be used in the HVAC system 10. The vapor compression system 14 can circulate a refrigerant through a circuit starting with a compressor 32 and including a condenser 34, expansion valve(s) or device(s) 36, and an evaporator or liquid chiller 38. The vapor compression system 14 can also include a control panel 40 that can include an analog to digital (A/D) converter 42, a microprocessor 44, a non-volatile memory 46, and an interface board 48. Some examples of fluids that may be used as refrigerants in vapor compression system 14 are hydrofluorocarbon (HFC) based refrigerants, such as R-410A, R-407, R-134a, hydrofluoro olefin (HFO), "natural" refrigerants like ammonia ($NH_3$), R-717, carbon dioxide ($CO_2$), R-744, or hydrocarbon based refrigerants, water vapor or any other suitable type of refrigerant. In some embodiments, the vapor compression system 14 may use one or more of each of variable speed drives (VSDs) 52, motors 50, compressors 32, condensers 34, expansion valves 36 and/or evaporators 38.

The motor 50 used with the compressor 32 can be powered by a variable speed drive (VSD) 52 or can be powered directly from an alternating current (AC) or direct current (DC) power source. The VSD 52, if used, receives AC power having a particular fixed line voltage and fixed line frequency from the AC power source and provides power having a variable voltage and frequency to the motor 50. The motor 50 can include any type of electric motor that can be powered by a VSD or directly from an AC or DC power source. In other embodiments, the motor 50 can be any other suitable motor type, such as a switched reluctance motor, an induction motor, or an electronically commutated permanent magnet motor. In still further embodiments, other drive mechanisms such as steam or gas turbines or engines and associated components can be used to drive the compressor 32.

The compressor 32 compresses a refrigerant vapor and delivers the vapor to the condenser 34 through a discharge passage. The compressor 32 can be a screw compressor in some embodiments. The refrigerant vapor delivered by the compressor 32 to the condenser 34 transfers heat to a fluid, such as water or air. The refrigerant vapor condenses to a refrigerant liquid in the condenser 34 as a result of the heat transfer with the fluid. The liquid refrigerant from the condenser 34 flows through the expansion device 36 to the evaporator 38. As shown in the illustrated embodiment of FIG. 3, the condenser 34 is water cooled and includes a tube bundle 54 connected to a cooling tower 56.

The liquid refrigerant delivered to the evaporator 38 absorbs heat from another fluid, which may or may not be the same type of fluid used for the condenser 34, and undergoes a phase change to a refrigerant vapor. In the embodiment shown in FIG. 3, the evaporator 38 includes a tube bundle having a supply line 60S and a return line 60R connected to a cooling load 62. A process fluid, such as water, ethylene glycol, calcium chloride brine, sodium chloride brine, or any other suitable liquid, enters the evaporator 38 via return line 60R and exits the evaporator 38 via supply line 60S. The evaporator 38 chills the temperature of the process fluid in the tubes. The tube bundle in the evaporator 38 can include a plurality of tubes and a plurality of tube bundles. The vapor refrigerant exits the evaporator 38 and returns to the compressor 32 by a suction line to complete the cycle.

Figure 4:
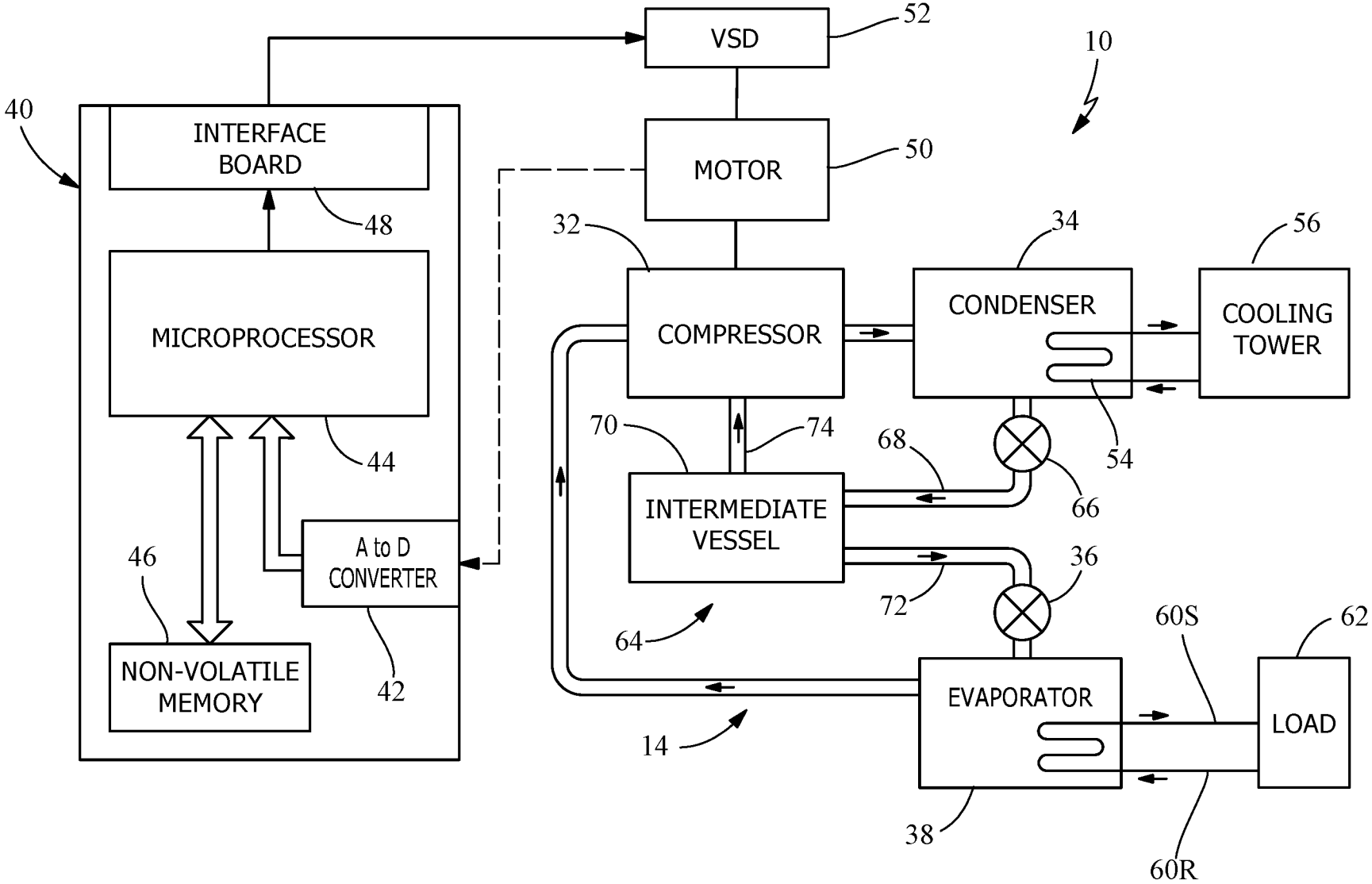

FIG. 4, shows an embodiment of the vapor compression system 14 having an intermediate circuit 64 incorporated between the condenser 34 and the expansion device 36. The intermediate circuit 64 has an inlet line 68 that can be either connected directly to, or can be in fluid communication with, the condenser 34. As shown, the inlet line 68 includes an expansion device 66 positioned upstream of an intermediate vessel 70. The intermediate vessel 70 can be a flash tank, also referred to as a flash intercooler, in some embodiments. In other embodiments, the intermediate vessel 70 can be configured as a heat exchanger or a "surface economizer." As shown in the illustrated embodiment of FIG. 4 (i.e., the intermediate vessel 70 is used as a flash tank), a first expansion device 66 operates to lower the pressure of the liquid received from the condenser 34. During the expansion process, a portion of the liquid vaporizes. The intermediate vessel 70 may be used to separate the vapor from the liquid received from the first expansion device 66 and may also permit further expansion of the liquid. The vapor may be drawn by the compressor 32 from the intermediate vessel 70 through a line 74 to the suction inlet, an opening, or opening arrangement at a pressure intermediate between suction and discharge or an intermediate stage of compression. The liquid that collects in the intermediate vessel 70 is at a lower enthalpy from the expansion process. The liquid from the intermediate vessel 70 flows in line 72 through a second expansion device 36 to the evaporator 38.

In some embodiments, the compressor 32 can include a compressor housing that contains the working parts of compressor 32. Vapor from the evaporator 38 can be directed to an intake passage of the compressor 32. The compressor 32 compresses the vapor with a compression mechanism and delivers the compressed vapor to the condenser 34 through a discharge passage. The motor 50 may be connected to the compression mechanism of the compressor 32 by a drive shaft.

Vapor flows from the intake passage of the compressor 32 and enters a compression pocket of the compression mechanism. The compression pocket is reduced in size by the operation of the compression mechanism to compress the vapor. The compressed vapor can be discharged into the discharge passage. For example, for a screw compressor, the compression pocket is defined between the surfaces of the rotors of the compressor 32. As the rotors of the compressor engage one another, the compression pockets between the rotors of the compressor 32, also referred to as lobes, are reduced in size and are axially displaced to a discharge side of the compressor 32.

As the vapor travels in the compression pocket, an opening or opening arrangement can be positioned in the compression mechanism prior to the discharge end. The opening or opening arrangement can provide a flow path for the vapor in the compression pocket from an intermediate point in the compression mechanism to the discharge passage. Specially configuring the opening or opening arrangement can control the volume ratio of the compressor 32 by throttling the flow of vapor from the opening or opening arrangement to the discharge passage, as will be discussed in greater detail below.

The volume ratio for the compressor 32 can be calculated by dividing the volume of vapor entering the intake passage (or the volume of vapor in the compression pocket before compression of the vapor begins) by the volume of vapor discharged from the discharge passage (or the volume of vapor obtained from the compression pocket after the compression of the vapor). Since the opening(s) or opening arrangement(s) is positioned prior to, or upstream from, the discharge end of the compression mechanism, vapor flow from the opening(s) or opening arrangement(s) to the discharge passage can increase the volume of vapor at the discharge passage. For example, partially compressed vapor received from the opening or opening arrangement has a relatively high volume and is being mixed with completely or fully compressed vapor from the discharge end of the compression mechanism having a relatively low volume. The volume of vapor from the opening(s) or opening arrangement(s) is greater than the volume of vapor from the discharge end of the compression mechanism because pressure and volume are inversely related, thus lower pressure vapor would have a correspondingly larger volume than higher pressure vapor. As such, the volume ratio for the compressor 32 can be adjusted based on controlling the amount of vapor that is permitted to flow from the opening(s) or opening arrangement(s). As will be discussed in additional detail below, unlike existing systems that include valves to selectably block opening(s) or opening arrangement(s), embodiments of the present disclosure are directed to configuring opening(s) or opening arrangement(s), which results in vapor flow control and enables automatic adjustment of the volume ratio of the compressor 32 between partial load and full load operation without utilizing moving parts or valves that selectably open/block the opening(s) or opening arrangement(s).

Figure 5:
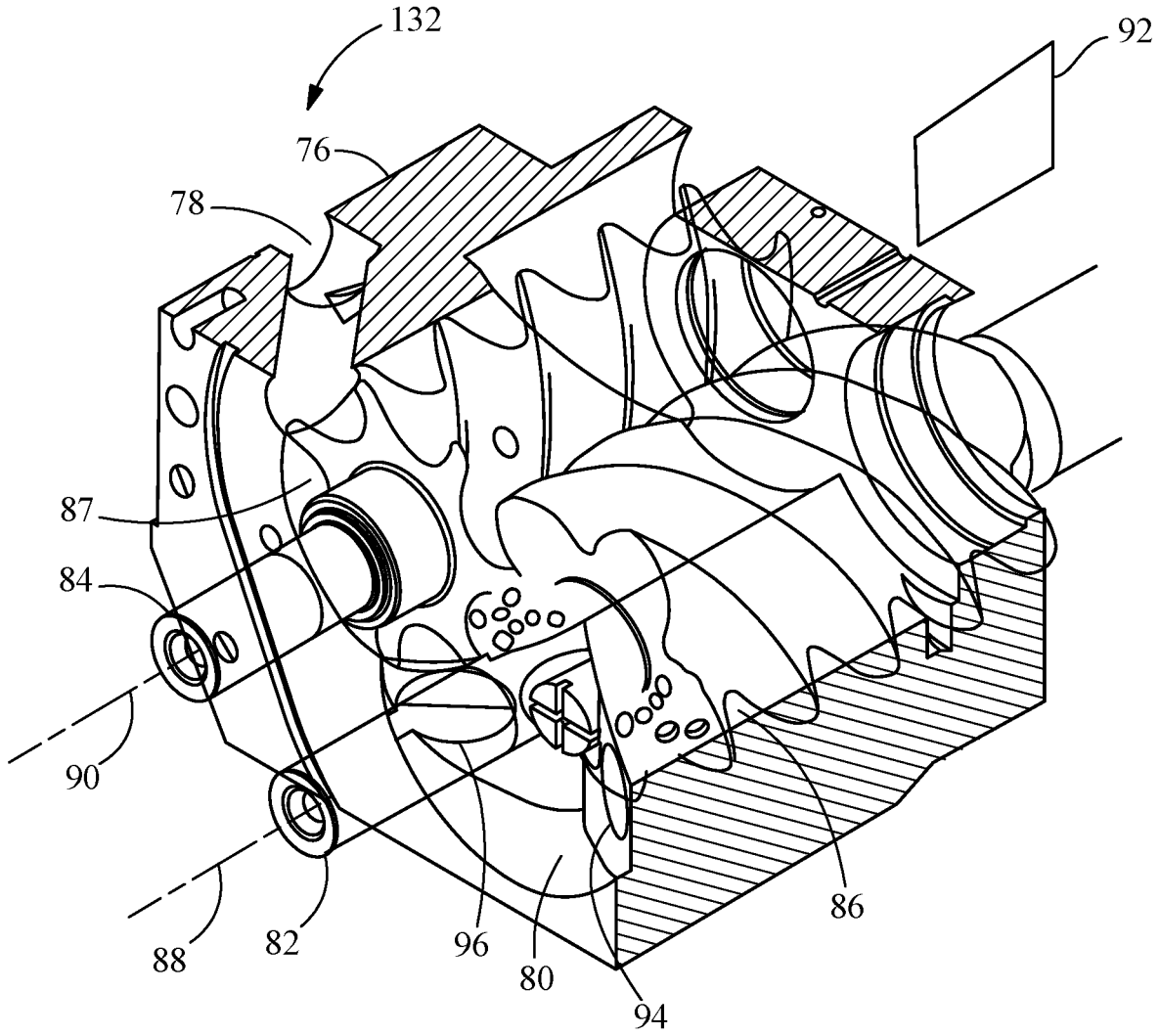
FIG. 5 shows a partial cut-away view of an embodiment of a variable volume ratio compressor, in accordance with an aspect of the present disclosure.
Figure 6:
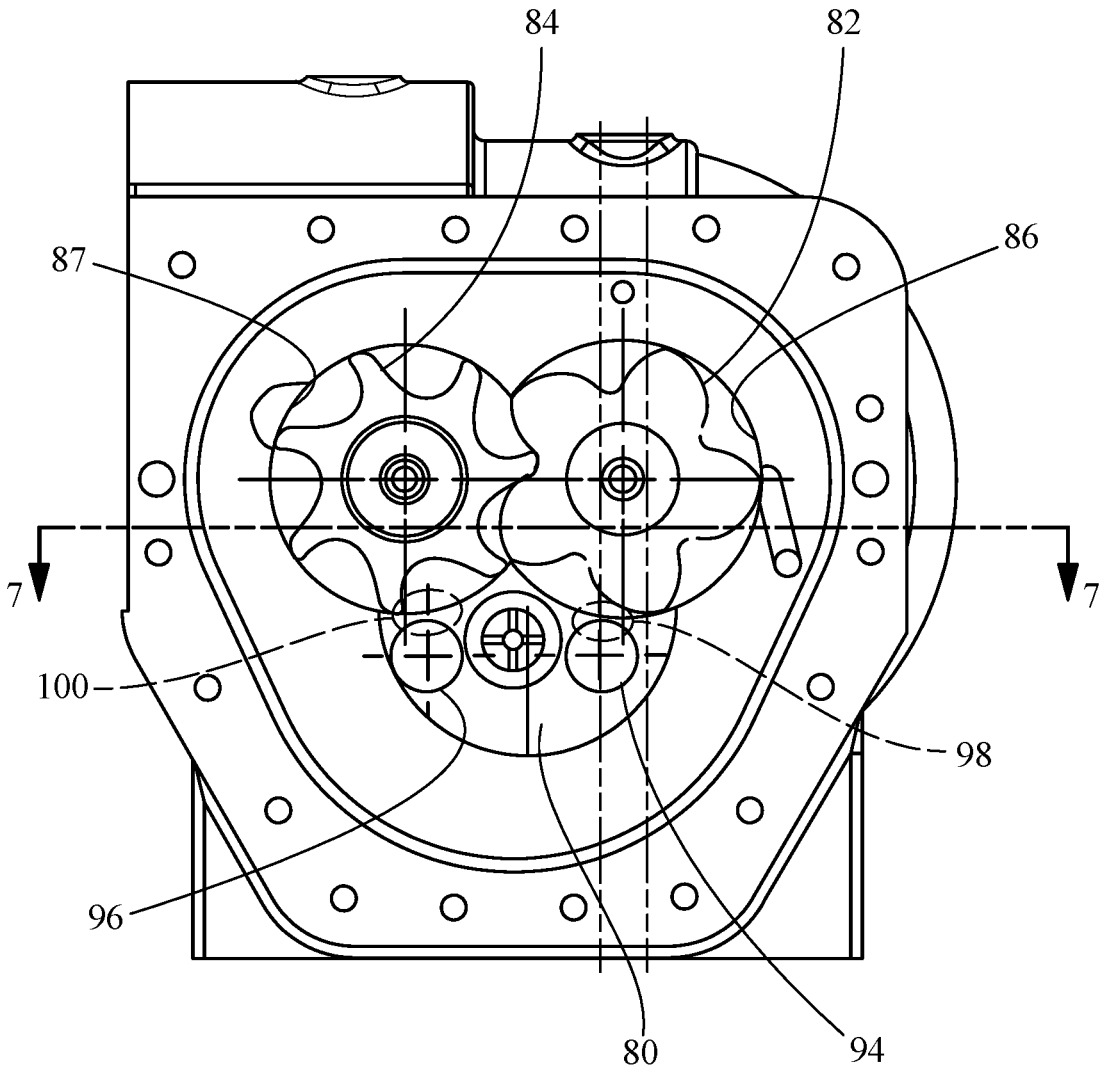
FIG. 6 shows an elevation view of an embodiment of the compressor of FIG. 5, in accordance with an aspect of the present disclosure.

FIGS. 5 and 6 show embodiments of the compressor 32. As shown in the illustrated embodiments, a compressor 132 includes a compressor housing 76 that contains the working parts of the compressor 132. Vapor from the evaporator 38 (see, e.g., FIG. 4) can be directed to an intake passage 78 of the compressor 132. The compressor 132 compresses the vapor and delivers the compressed vapor to the condenser 34 (see, e.g., FIG. 4) through a discharge passage 80. The motor 50 (see, e.g., FIG. 4) may be connected to rotors 82, 84 of the compressor 132 by a drive shaft. The rotors 82, 84 of the compressor 132 can matingly engage with each other via intermeshing lands and grooves. The rotors 82, 84 of the compressor 132 can revolve in respective accurately machined cylinders 86, 87 within the compressor housing 76.

Figure 7:
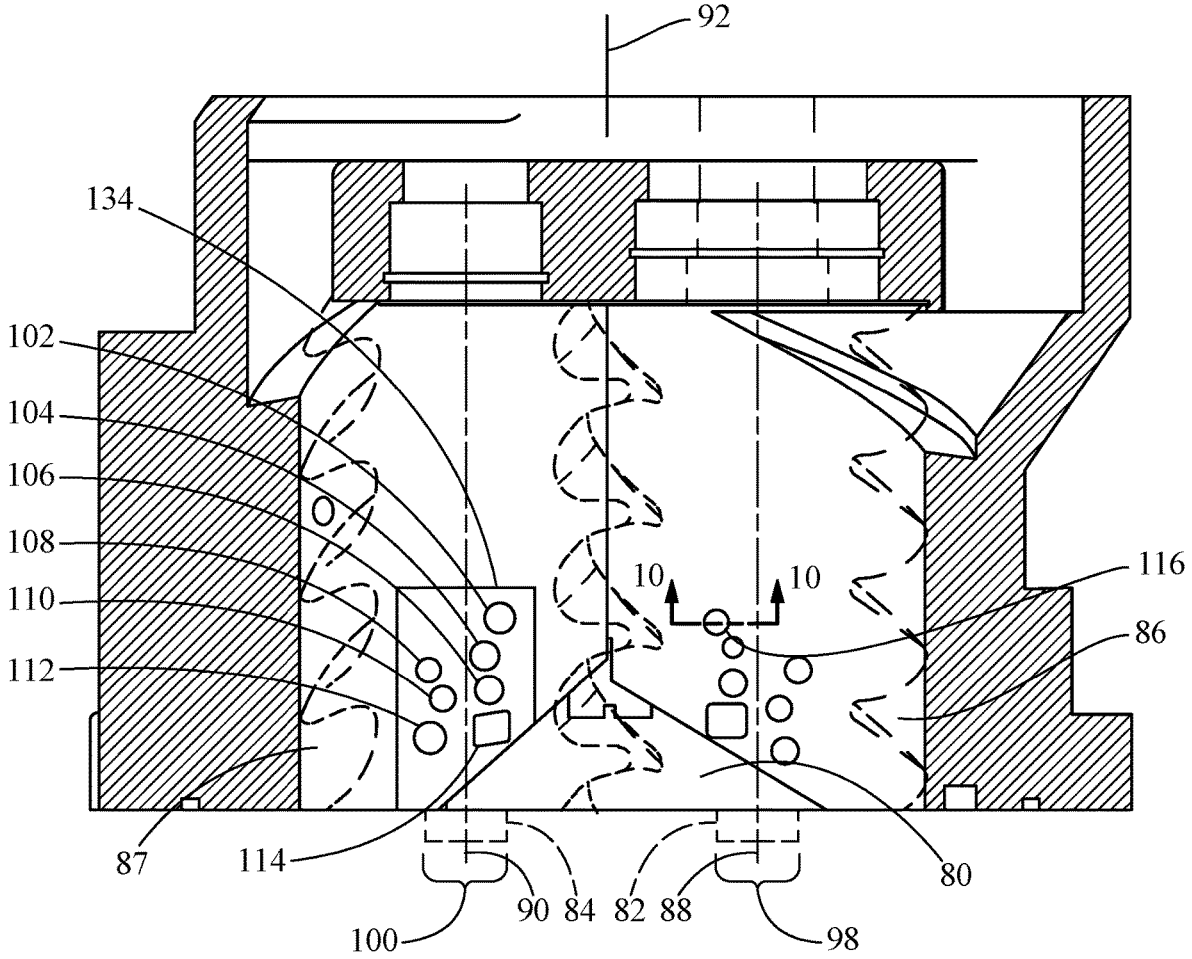
FIG. 7 shows a cross sectional view of an embodiment of the compressor of FIG. 6 taken along line 7-7 of FIG. 6, in accordance with an aspect of the present disclosure.
Figure 8:
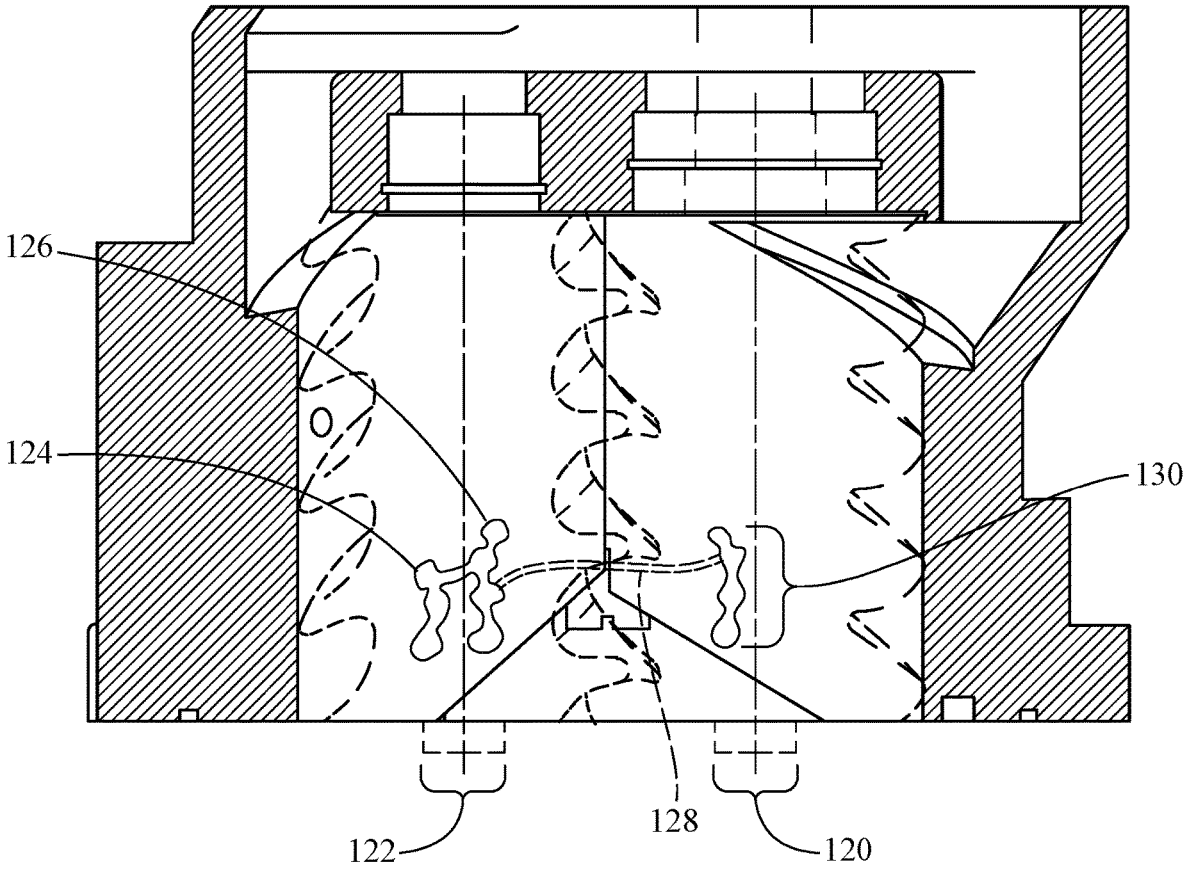
FIG. 8 shows a cross sectional view of an embodiment of the compressor of FIG. 6 taken along line 7-7 of FIG. 6, in accordance with an aspect of the present disclosure.

In the embodiments shown in FIGS. 5-7, openings or opening arrangements 98, 100 can be positioned in respective cylinders 86, 87 prior to the discharge end of the rotors 82, 84. An aperture 94 is positioned in fluid communication between the opening arrangement 98 and the discharge passage 80. An aperture 96 is positioned in fluid communication between the opening arrangement 100 and the discharge passage 80. The openings or opening arrangements 98, 100 and the respective apertures 94, 96 can provide a flow path for the vapor in the compression pocket from an intermediate point in respective rotors 82, 84 to the discharge passage 80. For purposes herein, the term "opening," "opening arrangement" and the like may be used interchangeably, as an "opening arrangement" may include one or more "openings." For example, as shown in FIG. 5, openings 102, 104, 106, 108, 110, 112, 114 collectively define opening arrangement 100, while as shown in FIG. 8, opening arrangement 124, 126 collectively define opening arrangement 122. As further shown in FIG. 8, a passageway 128 may connect opening arrangements 120, 126 such that opening arrangements 120, 124, 126 collectively define an opening arrangement 130. In other words, the opening arrangement 130 is in fluid communication with each of the rotors 82, 84.

In one embodiment, at least a portion of the opening arrangement(s) associated with the male rotor 82 and at least a portion of the opening arrangement(s) associated with the female rotor 84 can be symmetric about a plane 92 positioned between and parallel to an axis of rotation 88 of the male rotor 82 and an axis of rotation 90 of the female rotor 84. In one embodiment, at least a portion of the opening arrangement(s) associated with the male rotor 82 and at least a portion of the opening arrangement(s) associated with the female rotor 84 can be asymmetric about a plane 92 positioned between and parallel to an axis of rotation 88 of the male rotor 82 and an axis of rotation 90 of the female rotor 84. In one embodiment, the size of the opening(s) associated with the male rotor 82 may differ from the size of opening(s) associated with the female rotor 84. In one embodiment, the number of opening(s) associated the male rotor 82 may differ from the number of opening(s) associated with the female rotor 84. In one embodiment, the male rotor 82 has no openings. In one embodiment, the female rotor 84 has no openings. In one embodiment, the one or more opening(s) can be circular. In one embodiment, the one or more opening(s) can be noncircular. It is to be understood that any combination of the above is contemplated by and within the scope of the present disclosure.

As to the operation of embodiments of the disclosure, specially configured opening(s) or opening arrangement(s) enable automatic adjustment of the volume ratio of a variable volume rate compressor without valves or a moving mechanism to selectably block/open the opening(s) or opening arrangement(s). This is primarily achieved by controlling both the size (e.g., cross sectional area) and position of the opening(s) or opening arrangement(s) formed in the compressor housing. In response to varying load conditions, the speed of the compressor is similarly varied. For example, in response to increasing compressor speed, the pressure differential between the inlet and discharge passages increases, accompanied by an increase in refrigerant vapor flow velocity, as well as an increase in the temperature of vapor refrigerant discharged into the condenser 34. Conversely, in response to decreasing compressor speed, the pressure differential between the inlet and discharge passages decreases, accompanied by a decrease in refrigerant vapor flow velocity, as well as a decrease in the temperature of vapor refrigerant discharged into the condenser 34.

In response to an increase in pressure differential across the opening(s) from the lower range of partial load conditions, (e.g., less than about 25%) there is an increase in refrigerant vapor flow rate through a particular opening, such as the opening 102 of the opening arrangement 100 (see, e.g., FIG. 4), for providing bypass refrigerant vapor flow to the discharge passage 80. The opening 102 is positioned furthest from the discharge passage 80. At such reduced partial load conditions, due to low vapor refrigerant flow rate, compression essentially ends at the opening 102 because the opening 102 can accommodate a sufficient vapor flow rate to the discharge passage 80. However, in response to a further increase in pressure differential associated with increased compressor speed and vapor refrigerant velocity due to an increase in partial load conditions, the opening 102 begins to exhibit an ever-increasing amount of baffling or throttling until the vapor flow through the opening 102 essentially reaches a threshold amount. That is, as a practical matter, even in response to further increases in pressure differential and vapor refrigerant velocity flowing over the opening 102, the flow rate through the opening 102 does not appreciably increase, and thus, does not appreciably further increase the volume ratio of the compressor. In some embodiments, the opening 108 is approximately the same distance from the discharge passage 80 and similarly exhibits baffling or throttling until the vapor flow rate reaches a threshold amount under load conditions similar to the opening 102. In another embodiment, the distances between openings 102 and 108 can be different from each other and can have different load conditions before reaching threshold vapor flow rates.

As load conditions continue to increase, the opening 104, which is closer to the discharge passage 80 than the openings 102, 108 begins exhibiting baffling or throttling in a manner similar to that for the openings 102, 108 as previously discussed, albeit at a greater pressure differential. In a similar manner, openings positioned at ever-decreasing distances from the discharge passage 80 reach threshold vapor flow rates at ever-increasing load conditions. When properly sized and positioned, the openings of the opening arrangement 100 incrementally baffle vapor refrigerant flow over at least a substantial range of compressor operating loads, thereby maintaining the pressure inside the compressor at an amount that is approximately equal to the pressure in aperture 96 (see, e.g., FIG. 6), which is in fluid communication with, and positioned between, the opening arrangement 100 and the discharge passage 80. Similarly, when properly sized and positioned, the openings of the opening arrangement 98 incrementally baffle vapor refrigerant flow over at least a substantial range of compressor operating loads, thereby maintaining the pressure inside the compressor at an amount that is approximately equal to the pressure in aperture 94 (see, e.g., FIG. 6), which is in fluid communication with, and positioned between, the opening arrangement 98 and the discharge passage 80.

In summary, by virtue of the above-described baffling or throttling, openings 102, 104, 106, 108, 110, 112, 114 collectively defining the opening arrangement 100, as well as the opening arrangement 98, compensate for compressor volume ratio values, thereby enabling the openings to automatically adjust the volume ratio of compressor (i.e., without a slide valve or other mechanism to selectably open/close, or partially open/close the openings).

Figure 10:
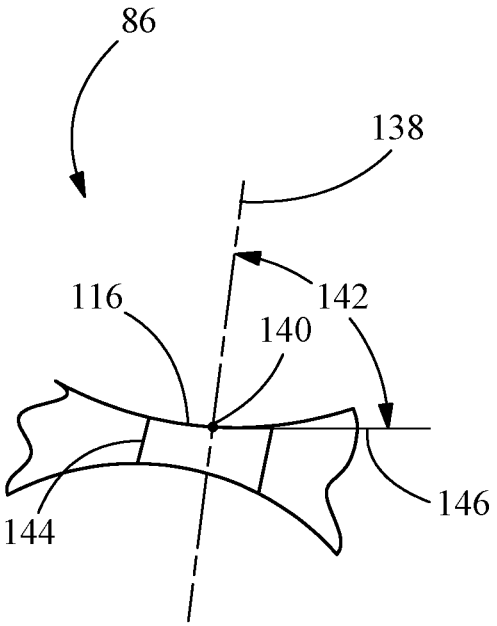
FIG. 10 shows a cross sectional view of an opening formed in a compressor taken along line 10-10 of FIG. 7, in accordance with an aspect of the present disclosure.

FIG. 10, which is taken along line 10-10 of FIG. 7, shows a cross-sectional view of the opening 116, having an axis 138 and a surface 144 that is parallel to the axis 138. In one embodiment, at least a portion of the surface 144 is parallel to the axis 138. A line 146 extends through a point of tangency 140 between the axis 138 and the cylinder 86. An angle 142 is subtended between the axis 138 and the line 146. In one embodiment, the angle 142 is 90° or the axis 138 and the line 146 are perpendicular to each other. In one embodiment, the angle 142 is not equal to 90° or the axis 138 and the line 146 are not perpendicular to each other. In one embodiment, the opening 116 has at least one axis that is non-coincident with the axis 138.

Figure 11:
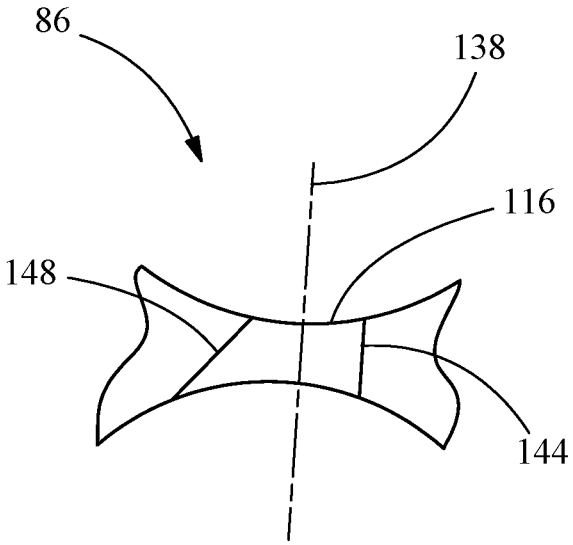
FIG. 11 shows a cross sectional view of an opening formed in a compressor taken along line 10-10 of FIG. 7, in accordance with an aspect of the present disclosure.

FIG. 11, which is taken along line 10-10 of FIG. 7, shows a cross-sectional view of an embodiment of the opening 116. As shown in the illustrated embodiment of FIG. 11, the opening 116 has an axis 138 and a surface 144 that is parallel to the axis 138, as well as a surface portion 148 that is not parallel to the axis 138. In other words at least the surface portion 148 of the opening 116 is oriented non-perpendicular to the point of tangency 140.

Figure 9:
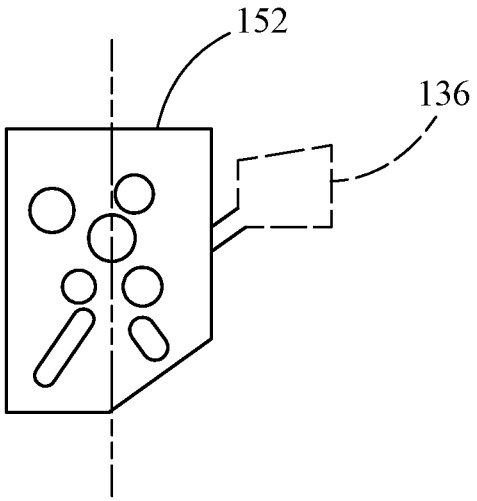
FIG. 9 shows an embodiment of a removable portion of the compressor of FIG. 7, in accordance with an aspect of the present disclosure.

It is to be understood that the size, shape, position, and/or surfaces of an opening arrangement is configured for a particular compressor and refrigerant. Therefore, for the same compressor, one or more of the size, shape, position, and/or surfaces of an opening arrangement will be different if configured for a different refrigerant. As a result, optionally, the opening arrangement 100 can be formed on a removable portion 134 that is secured to the compressor housing. In embodiments that utilize a different refrigerant, the removable portion 134 can be removed and replaced by another portion 152 (see, e.g., FIG. 9). In still further embodiments, the portion 152 can be incorporated into a slide valve 136.

While the embodiments illustrated in the figures and described herein are presently preferred, it should be understood that these embodiments are offered by way of example only. Other substitutions, modifications, changes and omissions may be made in the design, operating conditions and arrangement of the embodiments without departing from the scope of the present disclosure. Accordingly, the present disclosure is not limited to a particular embodiment, but extends to various modifications that nevertheless fall within the scope of the appended claims. It should also be understood that the phraseology and terminology employed herein is for the purpose of description only and should not be regarded as limiting.

Only certain features and embodiments of the present disclosure have been shown and described in the application and many modifications and changes may occur to those skilled in the art (e.g., variations in sizes, dimensions, structures, shapes and proportions of the various elements, values of parameters, mounting arrangements, use of materials, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. It is, therefore, to be understood that the appended claims are intended to cover all such modifications and changes as fall within the true spirit of the present disclosure. Furthermore, in an effort to provide a concise description of the exemplary embodiments, all features of an actual implementation may not have been described (i.e., those unrelated to the presently contemplated best mode of carrying out the embodiments of the present disclosure, or those unrelated to enabling the claimed subject matter). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A compressor, comprising:

an intake passage;

a discharge passage;

a compression mechanism, the compression mechanism being positioned to receive vapor from the intake passage and provide compressed vapor to the discharge passage; and at least one opening positioned in the compression mechanism to bypass a portion of the vapor in the compression mechanism to the discharge passage;

wherein the at least one opening being sized and positioned to automatically vary a volume ratio in the compressor in response to a varying pressure differential between the intake passage and the discharge passage, and wherein the at least one opening is configured to automatically vary the volume ratio in the compressor without a device that selectively opens the at least one opening, closes the at least one opening, or both.

2. The compressor of claim 1, wherein the volume ratio is variable between a partial load and a full load.

3. The compressor of claim 2, wherein the partial load is about twenty-five percent of the full load.

4. The compressor of claim 1, wherein the compressor is a screw compressor.

5. The compressor of claim 4, wherein the screw compressor includes a first rotor and a second rotor.

6. The compressor of claim 5, wherein the at least one opening is positioned in fluid communication with at least one of the first rotor and the second rotor.

7. The compressor of claim 5, wherein the at least one opening is positioned in fluid communication with each of the first rotor and the second rotor.

8. The compressor of claim 7, wherein at least a portion of the at least one opening is positioned symmetric to a plane positioned between and parallel to an axis of rotation of the first rotor and the second rotor.

9. The compressor of claim 7, wherein at least a portion of the at least one opening is positioned asymmetric to a plane positioned between and parallel to an axis of rotation of the first rotor and the second rotor.

10. The compressor of claim 1, wherein at least a portion of the at least one opening is circular.

11. The compressor of claim 1, wherein at least a portion of the at least one opening has an axis oriented non-perpendicularly to a point of tangency of the at least one opening with the compressor.

12. The compressor of claim 1, wherein at least a portion of a surface defining the at least one opening is oriented non-perpendicularly to a point of tangency of the at least one opening with the compressor.

13. The compressor of claim 1, wherein at least a portion of the at least one opening defines a passageway.

14. The compressor of claim 1, wherein the at least one opening is formed on a selectably removable portion of the compressor.

15. A method for controlling a volume ratio of a compressor, the method comprising:

providing a compression mechanism, the compression mechanism being positioned to receive vapor from an intake passage and provide compressed vapor to a discharge passage;

forming at least one opening positioned in the compression mechanism to bypass a portion of the vapor in the compression mechanism to the discharge passage, the at least one opening being sized and positioned to automatically vary a volume ratio in the compressor in response to a varying pressure differential between the intake passage and the discharge passage, wherein the at least one opening is configured to automatically vary the volume ratio in the compressor without a device that selectively opens the at least one opening, closes the at least one opening, or both.

16. The method of claim 15, further comprising operating the compressor at a variable speed.

17. The method of claim 16, wherein operating the compressor at the variable speed is in response to a system load varying between a partial load and a full load.

18. The method of claim 15, wherein the at least one opening positioned in the compression mechanism is formed on a selectably removable first portion of the compressor.

19. The method of claim 18, further comprising removing the first portion;

and installing a second portion in the compressor.

20. The method of claim 15, wherein the compression mechanism comprises a rotor.

* * * * *